US010871351B2

(12) United States Patent
Becker et al.

(10) Patent No.: US 10,871,351 B2
(45) Date of Patent: Dec. 22, 2020

(54) TACTICAL SHOULDER GARMENT

(71) Applicant: AARDVARK, LaVerne, CA (US)

(72) Inventors: Jonathan B. Becker, LaVerne, CA (US); Pei-hsuan Li, Whittier, CA (US); David Munoz Arriaga, Bloomington, CA (US)

(73) Assignee: AARDVARK, Laverne, CA (US)

( * ) Notice: Subject to any disclaimer, the term of this patent is extended or adjusted under 35 U.S.C. 154(b) by 112 days.

(21) Appl. No.: 16/404,238

(22) Filed: May 6, 2019

(65) Prior Publication Data

US 2020/0355469 A1 Nov. 12, 2020

(51) Int. Cl.

| | |
|---|---|
| ***A41D 13/05*** | (2006.01) |
| ***F41H 1/02*** | (2006.01) |
| ***F41H 5/013*** | (2006.01) |
| *A41D 1/04* | (2006.01) |

(52) U.S. Cl.

CPC ..... *F41H 1/02* (2013.01); *F41H 5/013* (2013.01)

(58) Field of Classification Search

CPC .... F41H 1/02; F41H 5/013; A45F 3/06; A45F 3/04; A45F 3/047; A41D 13/0012; A41D 13/015; A41D 13/0518; A41D 27/12; Y10S 2/92

See application file for complete search history.

(56) References Cited

U.S. PATENT DOCUMENTS 3,803,639 A * 4/1974 Cohen ..... F41H 1/02 2/2.5
3,901,579 A * 8/1975 Demerest ..... G08B 5/004 359/519
3,973,275 A * 8/1976 Blauer ..... F41H 1/02 2/2.5
4,096,977 A * 6/1978 Barville ..... A45F 5/00 224/148.6
4,266,297 A * 5/1981 Atkins ..... F41H 1/02 2/2.5
4,453,271 A * 6/1984 Donzis ..... A41D 13/0153 2/2.5
4,497,069 A * 2/1985 Braunhut ..... F41H 1/02 2/2.5
4,590,622 A * 5/1986 Wolfe ..... A41D 13/0512 2/16
4,610,035 A * 9/1986 Mattila ..... A41D 13/0518 2/16
4,639,946 A * 2/1987 Koenig ..... A41B 13/00 2/49.1
4,669,125 A * 6/1987 Allen ..... A41D 13/0151 2/252
5,060,314 A * 10/1991 Lewis ..... F41H 1/02 2/2.5
5,072,453 A * 12/1991 Widder ..... F41H 1/02 2/2.5
5,373,582 A * 12/1994 Dragone ..... F41H 1/02 2/102
5,431,318 A * 7/1995 Garcia ..... F41C 33/00 2/2.5
5,628,725 A * 5/1997 Ostergard ..... A61F 5/3746 602/20
5,754,982 A * 5/1998 Gainer ..... F41H 1/02 2/102

(Continued)

*Primary Examiner* — Robert H Muromoto, Jr.
(74) *Attorney, Agent, or Firm* — Vista IP Law Group LLP

(57) ABSTRACT

A tactical shoulder garment with a ballistic carrier and a removably attachable shoulder strap.

20 Claims, 7 Drawing Sheets

(56) References Cited

U.S. PATENT DOCUMENTS 5,991,925 A * 11/1999 Wu ..... A41D 13/0012 2/102
7,047,570 B2 * 5/2006 Johnson ..... F41H 1/02 2/102
7,243,376 B2 * 7/2007 Johnson ..... F41H 1/02 2/102
7,401,363 B2 * 7/2008 Hatfield ..... F41H 1/02 2/2.5
7,571,493 B1 * 8/2009 Purvis ..... F41H 1/02 2/2.5
7,917,967 B2 * 4/2011 Osborne ..... F41H 1/02 2/2.5
7,937,780 B2 * 5/2011 Matic ..... F41H 1/02 2/465
7,979,917 B2 * 7/2011 Osborne ..... F41H 1/02 2/2.5
7,987,523 B2 * 8/2011 Cole ..... A45F 5/00 2/102
8,353,065 B1 * 1/2013 Crye ..... F41H 1/02 2/102
8,370,962 B2 * 2/2013 McBride ..... F41H 1/02 2/2.5
8,418,265 B1 * 4/2013 Storms, Jr. ..... F41H 1/02 2/102
8,499,362 B2 * 8/2013 Dennis ..... F41H 1/02 2/102
8,528,112 B2 * 9/2013 Blauer ..... F41H 1/02 2/2.5
8,578,513 B2 * 11/2013 Carlson ..... F41H 1/02 2/2.5
8,776,262 B2 * 7/2014 Blauer ..... F41H 1/02 2/2.5
8,826,462 B2 * 9/2014 Storms, Jr. ..... F41H 1/02 2/2.5
9,222,757 B2 * 12/2015 Seuk ..... F41H 1/02
10,004,936 B1 * 6/2018 Ekstrom ..... A63B 21/4007
10,139,199 B2 * 11/2018 Blauer ..... F41H 1/02
10,527,388 B2 * 1/2020 Son ..... F16B 2/10
10,631,584 B2 * 4/2020 LeMarbe ..... A41D 1/04
10,638,816 B2 * 5/2020 Strum ..... A41F 15/002
2007/0028339 A1 * 2/2007 Carlson ..... F41H 1/02 2/2.5
2008/0263737 A1 * 10/2008 Parks ..... F41H 1/02 2/2.5
2008/0295210 A1 * 12/2008 Matic ..... F41H 1/02 2/2.5
2011/0023203 A1 * 2/2011 Dovner ..... F41H 1/02 2/2.5
2012/0124713 A1 * 5/2012 Blauer ..... F41H 1/02 2/102
2012/0174273 A1 * 7/2012 Frost ..... F41H 1/02 2/2.5
2013/0036537 A1 * 2/2013 Reynolds ..... F41H 1/02 2/456
2014/0082809 A1 * 3/2014 Blauer ..... F41H 1/02 2/2.5
2014/0130224 A1 * 5/2014 Lurio ..... A41F 5/00 2/2.5
2016/0116255 A1 * 4/2016 Billotte ..... F41H 1/02 2/2.5
2017/0307335 A1 * 10/2017 Skifstad ..... A45F 3/06
2017/0332768 A1 * 11/2017 Fraile Nuez ..... A45F 3/06
2019/0154404 A1 * 5/2019 LeMarbe ..... F41H 1/02
2019/0380478 A1 * 12/2019 Rushing ..... F41H 1/02

* cited by examiner

TACTICAL SHOULDER GARMENT

TERMINOLOGY

"Hook and loop" as used herein means traditional hook and loop such as VELCRO, as well as other similar touch fasteners such as 3M's DUAL LOCK fasteners. Reference numbers are used with subscripts "a" and "b" (e.g., 18*a*, 18*b*), to represent complimentary hook and loop surfaces. In other words, surface 18*a* would mate with surface 18*b*, either because surface 18*a* is hook and surface 18*b* is loop, or surface 18*a* is loop and surface 18*b* is hook.

FIELD OF THE INVENTION

The invention relates generally to tactical body armor, and more specifically to a tactical carrier system for protecting the shoulder and upper arm area.

BACKGROUND

Tactical body armor typically includes a vest or similar garment which carries ballistic armor. An additional carrier for shoulder/upper arm protection is often attached to the vest by a strap having buckles, hook and loop fasteners. Modular Lightweight Load-carrying Equipment ("MOLLE") webbing, and/or snaps, or the like. The strap is typically elastic, and is permanently fixed to the shoulder/upper arm carrier by, e.g., reinforced stitching. As such, when the elastic (or other portion of the strap) wears out or otherwise fails, the entire shoulder/upper arm carrier must be replaced. There is thus a need for a shoulder/upper arm ballistic carrier system with a replaceable shoulder strap.

SUMMARY OF THE INVENTION

One aspect of the tactical shoulder garment of the present invention includes a ballistic carrier with a removable (and hence replaceable) shoulder strap for removably attaching the carrier to a tactical vest or other garment. Another aspect includes an arm strap for removably securing the carrier to a person wearing the garment (hereafter "wearer") by removably securing the carrier to the upper arm area. Another aspect includes the shoulder strap being elastic and having a strap-stop on one end to be caught and retained in the carrier while the other end of the strap extends out from the carrier for removable attachment to a tactical vest.

The present invention thus provides a tactical shoulder garment with a detachable (and hence replaceable) shoulder strap.

DRAWINGS

DETAILED DESCRIPTION

Figure 1:
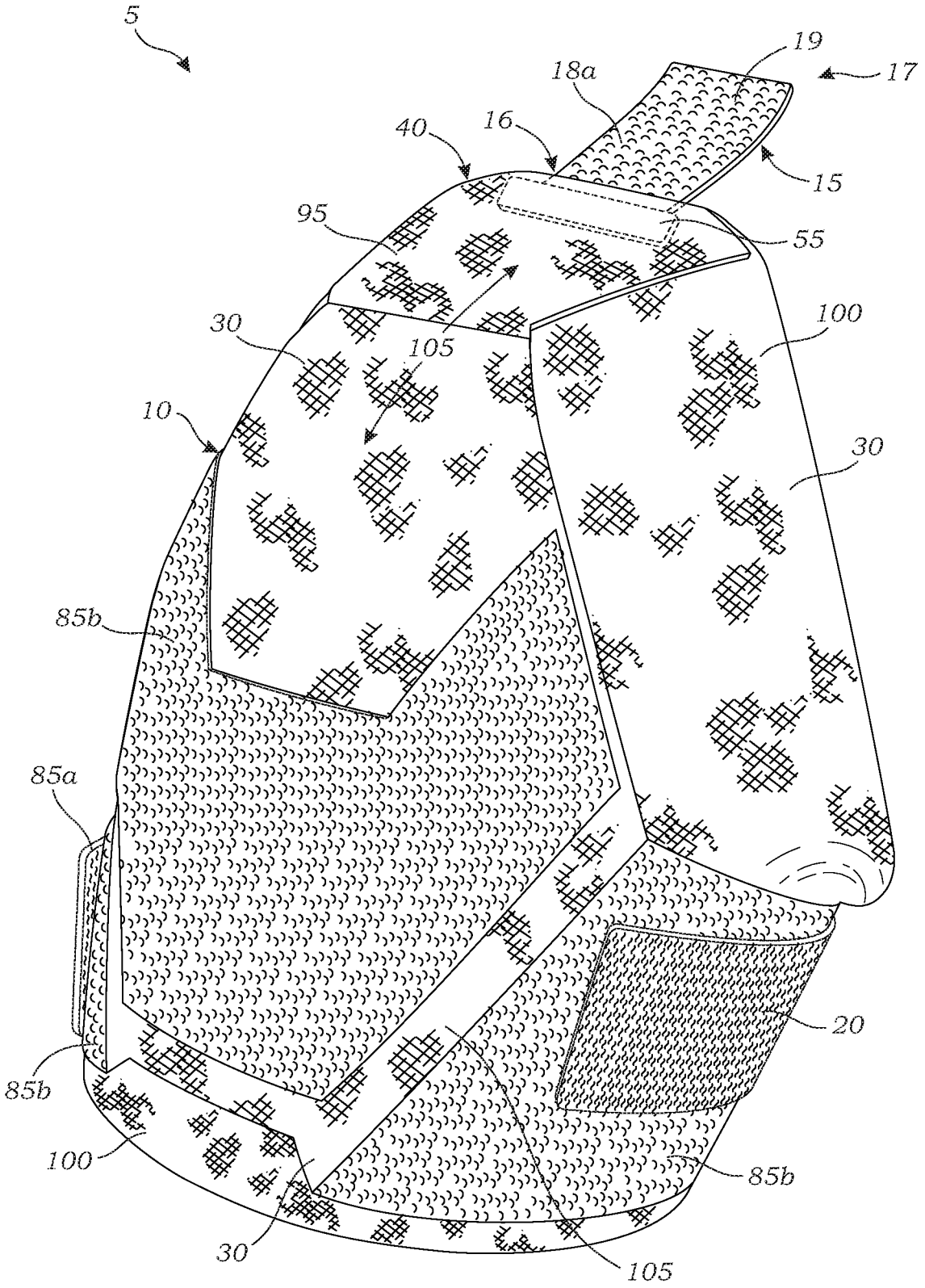
FIG. 1 shows a front perspective view of a tactical shoulder garment in accordance with an embodiment of the present invention.
Figure 2:
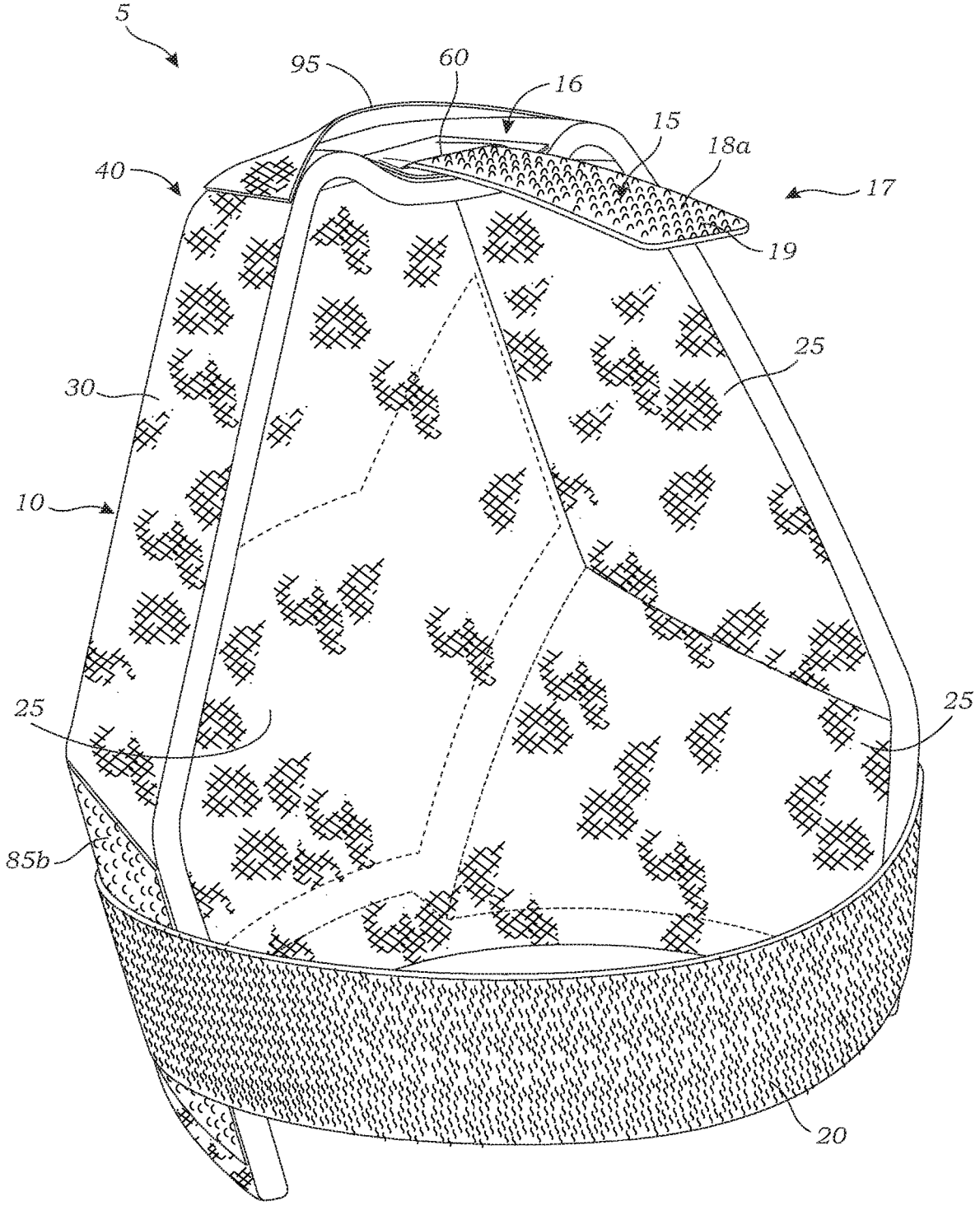
FIG. 2 shows a back perspective view of the shoulder garment of FIG. 1.

The present invention relates to a tactical shoulder garment (5) with a ballistic carrier (10) and a removably attachable shoulder strap (15). FIG. 1 shows a front perspective view of a tactical shoulder garment (5) in accordance with an embodiment of the present invention. This embodiment also includes an arm strap (20) to help removably secure the carrier (10) to the upper arm area of a wearer. FIG. 2 shows a back perspective view of the shoulder garment (5) of FIG. 1.

Figure 4:
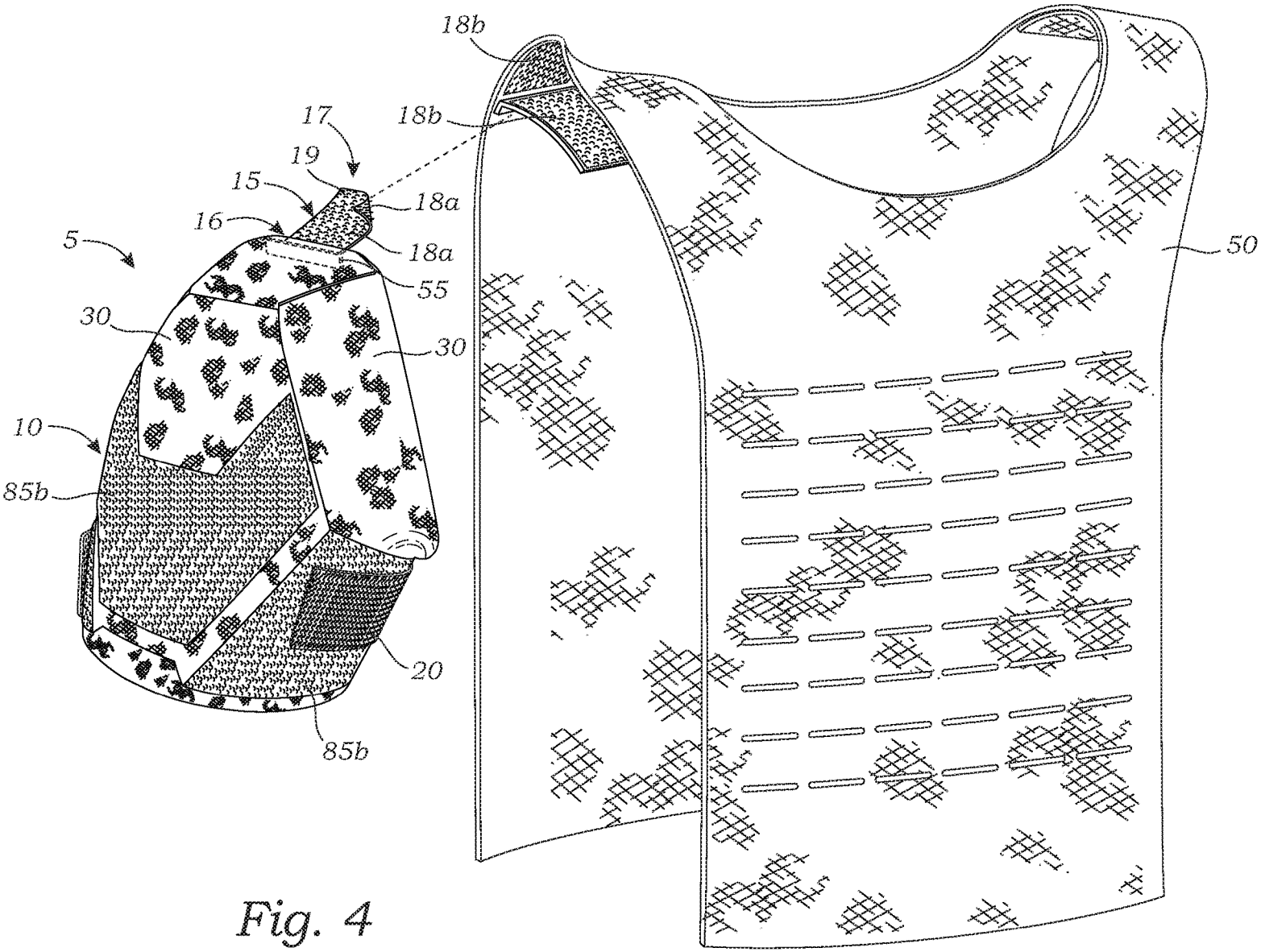
FIG. 4 shows an exploded view of the shoulder garment of FIG. 1 before being removably attached to a tactical vest.

The shoulder strap (15) has a proximal end (16) closest to the carrier (10) when in use, and a distal end (17) farthest from the carrier (10) when in use. The shoulder strap (15) comprises elastic or other stretchable material and is preferably an elastic band (19) with a hook and loop surface (18*a*) at the distal end (17). This allows the distal end (17) of the shoulder strap (15) to be removably attached to a tactical vest (50) having a complimentary hook and loop surface (18*b*) positioned to mate with the hook and loop surface (18*a*) of the shoulder strap (15). The shoulder strap (15) may have hook and loop surfaces (18*a*) on both sides, to mate with two separate complimentary hook and loop surfaces (18*b*) on the tactical vest (50). An example of this is seen in FIG. 4, showing the vest (50) with two of the same hook and loop surfaces (18*a*) in the shoulder area to sandwich the shoulder strap (15) and mate with both the top and bottom hook and loop surfaces (18*a*) of the shoulder strap (15). In one embodiment, the shoulder strap (15) has a hook and loop surface (18*a*) on top but has a complimentary hook and loop surface (18*b*) on bottom, both configured to mate with respective complimentary hook and loop surfaces (18*b*) and (18*a*) on the tactical vest (50). In this embodiment, the hook and loop surfaces (18*b*), (18*a*) of the tactical vest (50) are thus configured to also mate with each other so when they are not in use sandwiching a shoulder strap (15), they may be removably secured to each other. This is represented at the left shoulder of the vest (50) in FIG. 4. Other means such as MOLLE webbing, snaps, ties, buttons, slide locks, and/or any other suitable means may be used in addition or alternatively to removably attach the shoulder strap (15) to the tactical vest (50).

The shoulder strap (15) has a strap-stop (55) attached at the proximal end (16). The strap-stop (55) may be attached to the shoulder strap (15) by stitching, glue, ties, buckles, snaps, and/or other suitable means. The strap-stop (55) is configured to allow the shoulder strap (15) to be removably attached to the carrier (10) at the proximal end (16), as further described herein. The strap-stop (55) may be cloth, rigid plastic, soft plastic, rubber, PVC, metal, or any other material suitable to allow the strap-stop (55) to serve its intended function as described herein. Soft, flexible plastic works well to conform to changes in position/shape of the carrier (10) in use, while still providing desired rigidity and comfort. The strap-stop (55) may be substantially flat (e.g., a flexible plastic when not stressed), and shaped to catch onto a reinforced area inside the pouch (35) as described herein. Such shape may be a regular geometric shape such as a square, other rectangle, oval, circle, star, etc., or other suitable shape. The strap-stop (55) may include a hook and loop surface (not shown) complimentary to a hook and loop surface (not shown) at the opening (60) of the top portion (40) of the pouch (35), for further securement thereto.

The carrier (10) has a contact portion (25) and an exposed portion (30). The contact portion (25) refers generally to the portion that contacts the shoulder and upper arm area of the wearer. The exposed portion (30) refers generally to the portion that is exposed, i.e., does not contact the shoulder and upper arm area of the wearer. The contact portion (25) and the exposed portion (30) are connected together (e.g., by stitching) to form a pouch (35) having a top portion (40) and a bottom portion (45). The top portion (40) of the pouch (35) has an opening (60), such as a slit, configured to allow the distal end (17) of the shoulder strap (15) to pass therethrough and to catch the strap-stop (55) on an inside of the pouch (35) to prevent the strap-stop (55) from passing therethrough. This is best seen with reference to FIG. 2 and FIG. 7. This allows the shoulder strap (15) to be removably attached to the carrier (10) at the proximal end (16) of the shoulder strap (15). The inside of the pouch (35) may be reinforced at the opening (60) of the top portion (40) of the pouch (35) with plastic, thick cloth, vinyl, etc. (90), to assist catching the strap-stop (55).

Figure 3:
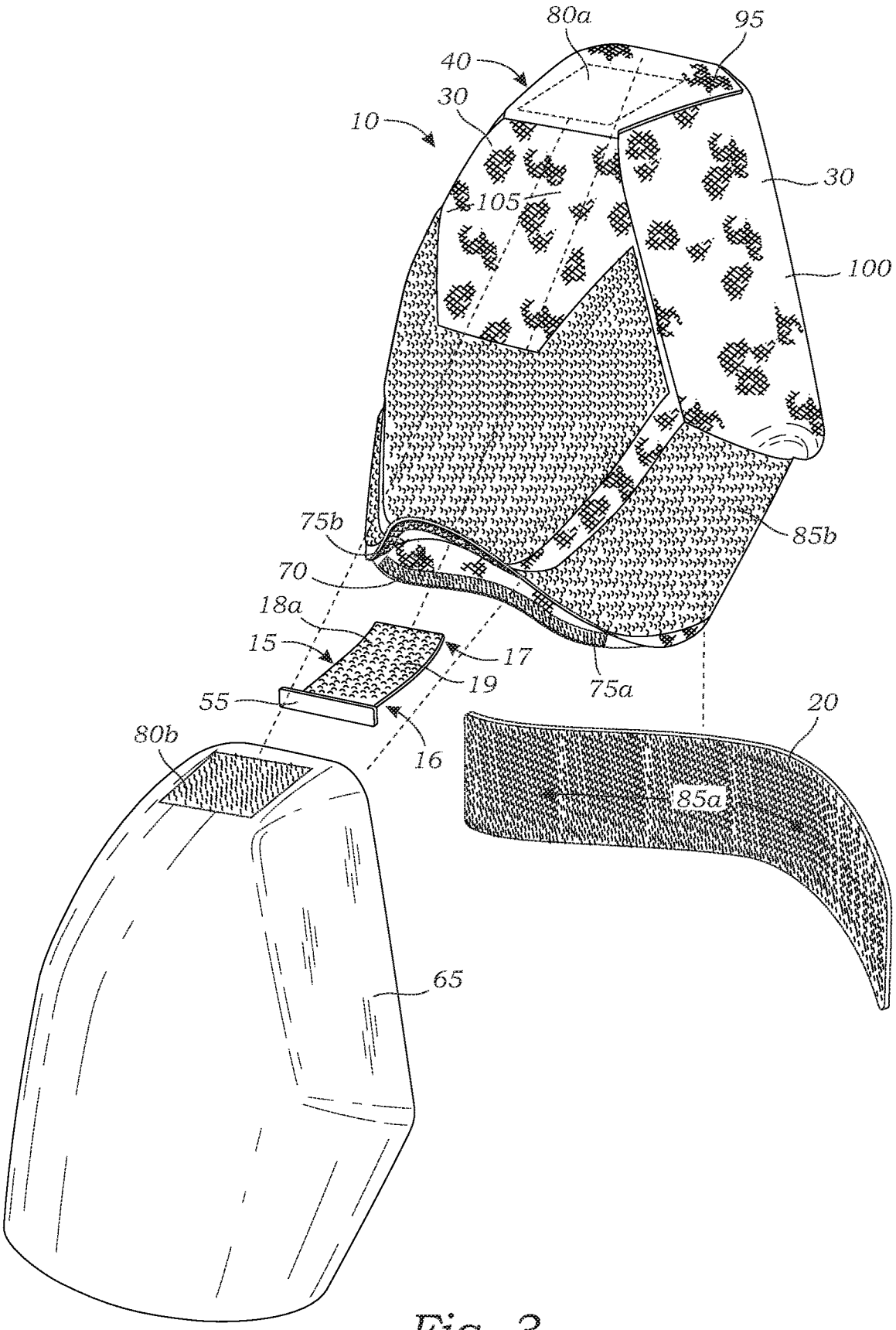
FIG. 3 shows an exploded view of the shoulder garment of FIG. 1, along with a ballistic to be inserted therein.
Figure 6:
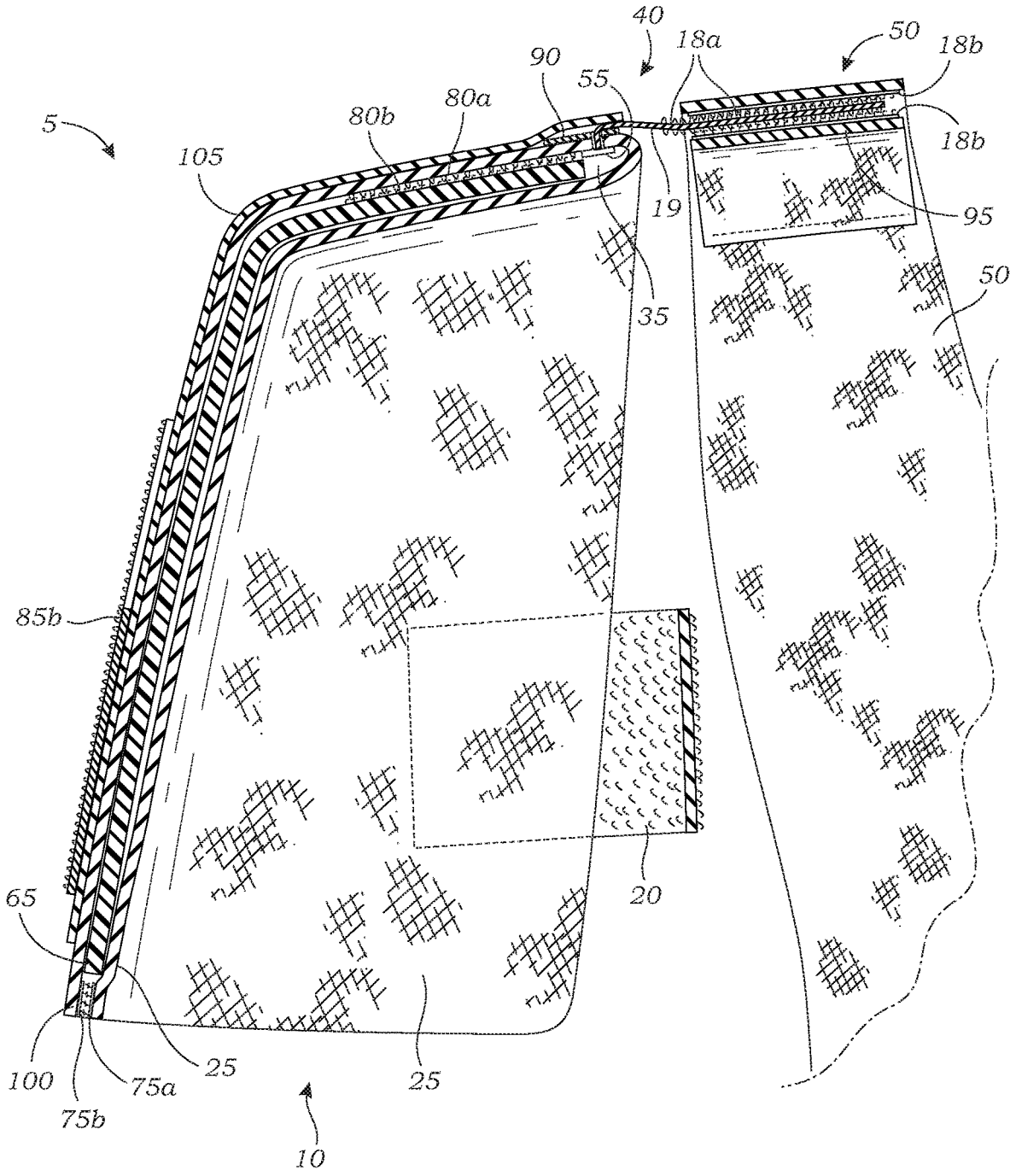
FIG. 6 shows a cross section of the shoulder garment of FIG. 5 along line 6-6.
Figure 7:
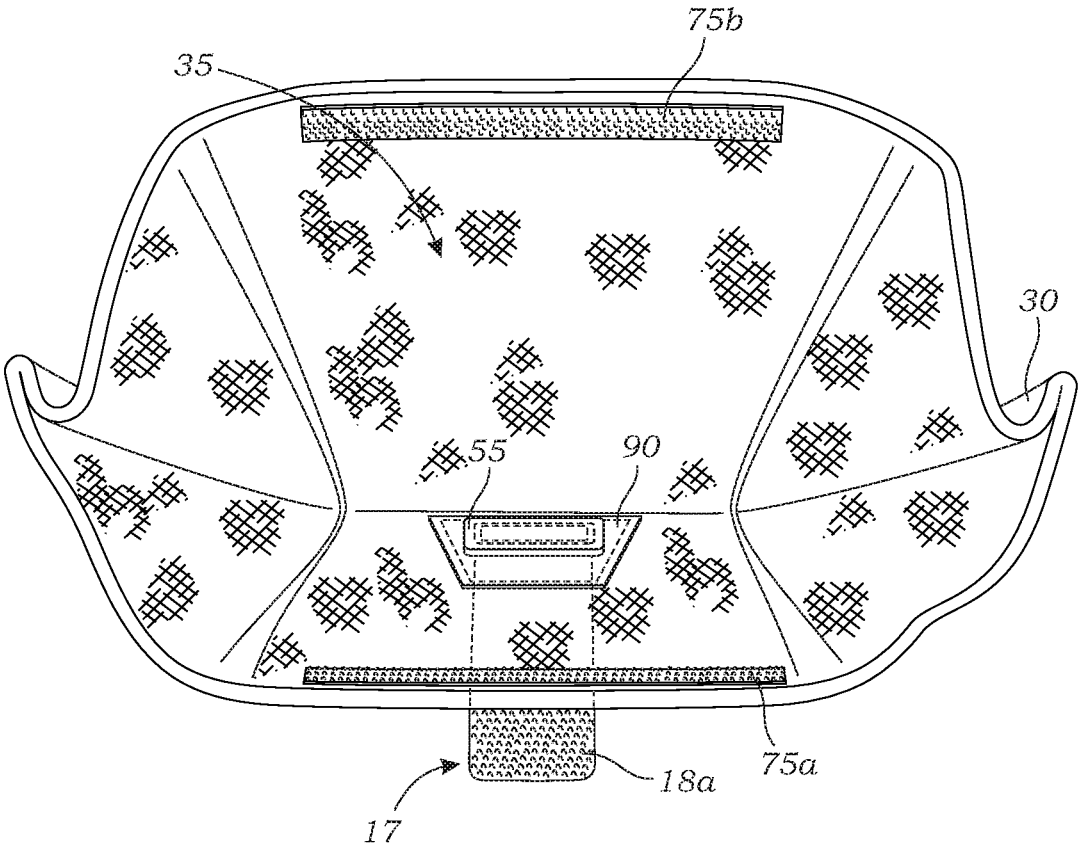
FIG. 7 shows an inside-pouch perspective view of a carrier and shoulder strap system in accordance with an embodiment of the present invention.

The bottom portion (45) of the pouch (35) has an opening (70) configured to receive ballistic armor (65). The opening (70) at the bottom portion (45) of the pouch (35) may be closeable to removably secure the ballistic armor (65). This may be accomplished using complimentary hook and loop surfaces (75*a*), (75*b*) on opposing faces of the inside of the pouch (35) at the opening (70) of the bottom portion (45) of the pouch (35), as seen in FIG. 3, FIG. 6, and FIG. 7. This may also be accomplished using zippers, snaps, lacing, or other suitable means. The carrier (10) may also have a hook and loop surface (80*a*) on the inside of the pouch (35) to mate with a complimentary hook and loop surface (80*b*) on the ballistic armor (65), as seen in FIG. 3 and FIG. 6, to help further secure the ballistic armor (65) in position within the pouch (35). The armor (65) may be soft armor, hard armor, or a combination thereof.

The carrier (10) may comprise various layers of material or fabric for aesthetics, reinforcement, or other functionality. For example, as seen in the drawings, there may be an under layer of fabric (100), an over layer of fabric (105), and hook and loop surfaces (85*b*) all part of the exposed portion (30) of the carrier (10). Additionally, there may be a flap or hood (95) to cover the opening (60) at the top portion (40) of the pouch (35). The flap (95) may be stitched around the edges and/or may have a hook and loop surface or other means for further securing to the carrier (10).

Figure 5:
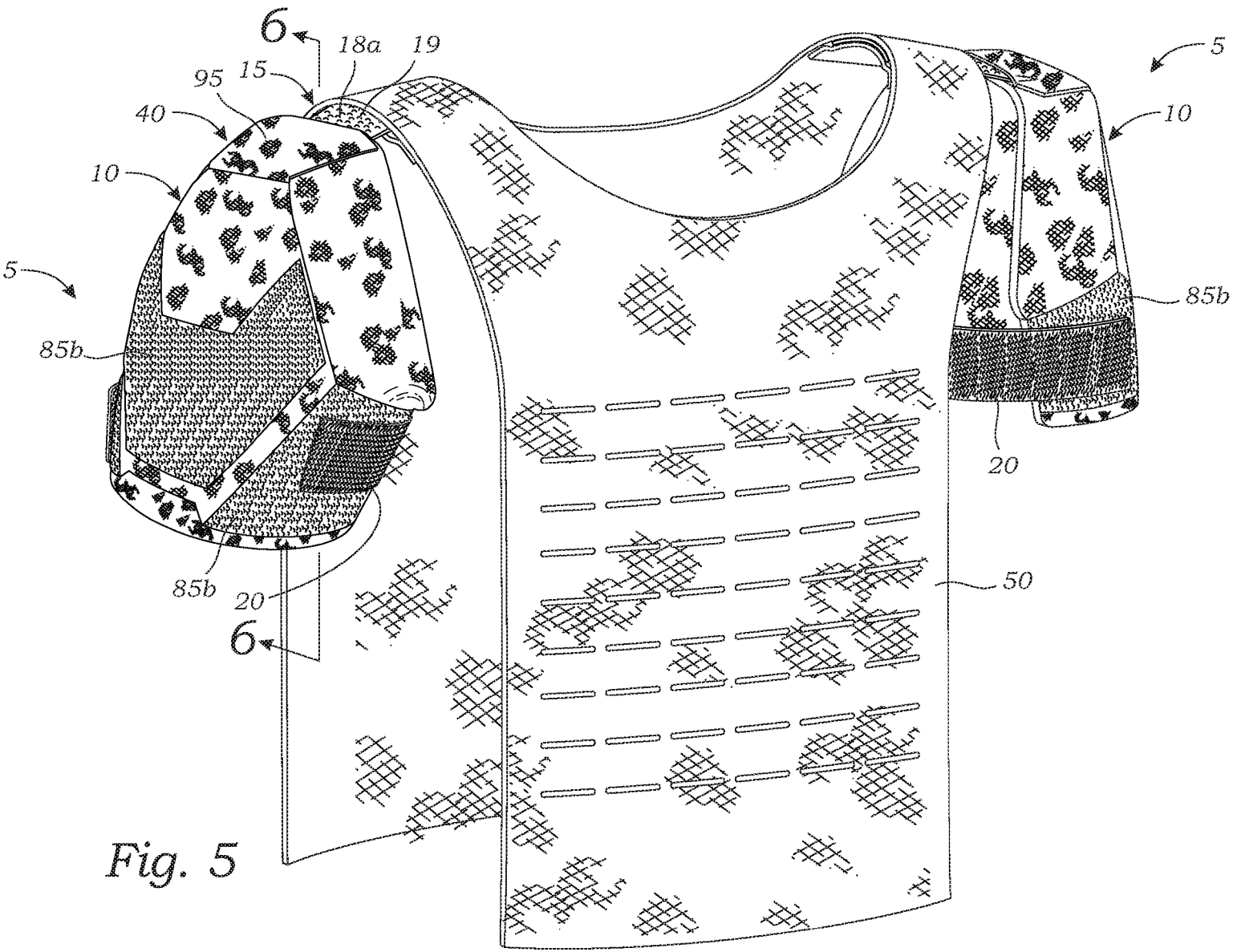
FIG. 5 shows the shoulder garment of FIG. 4 removably attached to a tactical vest.

As described herein, a tactical shoulder garment (5) in accordance with an embodiment of the present invention includes a ballistic carrier (10) configured to fit over a human shoulder and upper arm area, the carrier (10) having a top portion (40) with an opening (60) and a bottom portion (45) with an opening (70), in which the opening (60) of the bottom portion (45) of the carrier (10) is closeable to removably secure ballistic armor (65) within the carrier (10). The carrier (10) is removably attachable to a tactical vest (50) using a shoulder strap (15) comprising an elastic band (19) with a proximal end (16) and a distal end (17), the proximal end (16) being removably attachable to the top portion (40) of the carrier (10) near the opening (60) of the top portion (40) of the carrier (10), the distal end (17) being removably attachable to the tactical vest (50). The carrier (10) with ballistic armor (65) removably secured therein (in the pouch (35)) is generally shaped and configured to fit over the shoulder and upper arm area of the wearer, as best seen in FIG. 4 and FIG. 5. The carrier (10) may be cloth, plastic, nylon, vinyl, and/or other suitable material. The carrier (10) may be further secured in place with an arm strap (20) that wraps around the upper arm area of the wearer around the outside (i.e., exposed portion (30)) of the carrier (10). The arm strap (20) may be an elastic band with a hook and loop surface (85*a*) complimentary to hook and loop surfaces (85*b*) on the exposed portion (30) of the carrier (10), as the means for removably securing the carrier (10) to the upper arm area of the wearer. The arm strap (20) may also be laced, snapped, tied, or secured using other suitable means.

In use, typically a wearer will insert the distal end (17) of the shoulder strap (15) through the opening (60) at the top portion (40) of the carrier (10) from inside the pouch (35), then pull the distal end (17) of the shoulder strap (15) through the opening (60) until the strap-stop (55) catches against the reinforced area (90) at the opening (60) of the top portion (40) of the pouch (35). The distal end (17) of the shoulder strap (15) is then removably secured to the tactical vest (50) by complimentary hook and loop surfaces (18*a*) on the shoulder strap (15) and (18*b*) on the vest (50). Various lengths of shoulder straps (15) may be used to accommodate various sizes of shoulders. The wearer then dons the vest (50), and may further secure the carrier (10) to the shoulder/upper arm area using the arm strap (20) as described herein. Ballistic armor (65) may be inserted into the pouch (35) of the carrier (10) at any time and secured as described herein. If the shoulder strap (15) is damaged, incorrectly sized, worn, or fails for any other reason, it may be removed and replaced with a substitute strap (15), without having to replace the entire tactical shoulder garment.

A tactical shoulder garment (5) with a carrier (10) and a removable shoulder strap (15) has thus been described, which allows replacement of the shoulder strap (15) as needed without having to replace the entire garment (5).

What is claimed is:

1. A tactical shoulder garment comprising:

a carrier; and a shoulder strap;

wherein the shoulder strap comprises an elastic band with a proximal end and a distal end, the proximal end having a strap-stop attached thereto configured to allow the shoulder strap to be removably attached to the carrier at the proximal end, the distal end being configured to allow the shoulder strap to be removably attached to a tactical vest at the distal end; and wherein the carrier comprises a contact portion and an exposed portion connected together to form a pouch configured to fit over a human shoulder and upper arm area, the pouch having a top portion with an opening configured to allow the distal end of the shoulder strap to pass therethrough and to catch the strap-stop on an inside of the pouch, and a bottom portion with an opening configured to receive ballistic armor.

2. The tactical shoulder garment of claim 1, further comprising an arm strap configured to removably secure the carrier to the upper arm area.

3. The tactical shoulder garment of claim 2, wherein the exposed portion of the carrier comprises a hook and loop surface, and the arm strap comprises a hook and loop surface complimentary to the hook and loop surface of the exposed portion of the carrier configured for removably securing to the carrier to the upper arm area.

4. The tactical shoulder garment of claim 1, wherein the inside of the pouch is reinforced at the opening of the top portion of the pouch.

5. The tactical shoulder garment of claim 1, wherein the opening at the top portion of the pouch is a slit.

6. The tactical shoulder garment of claim 5, wherein the strap-stop comprises flexible plastic.

7. The tactical shoulder garment of claim 5, wherein the strap-stop is substantially flat and rectangular.

8. The tactical shoulder garment of claim 5, wherein the inside of the pouch is reinforced at the opening of the top portion of the pouch.

9. The tactical shoulder garment of claim 1, wherein the strap-stop comprises a hook and loop surface, and the contact portion of the carrier at the opening of the top portion of the pouch has a hook and loop surface complimentary to the hook and loop surface of the strap-stop.

10. The tactical shoulder garment of claim 1, wherein the opening of the bottom portion of the pouch is closeable to removably secure the ballistic armor.

11. The tactical shoulder garment of claim 10, wherein the opening of the bottom portion of the pouch is closeable by complimentary hook and loop surfaces on opposing faces of the inside of the pouch at the opening of the bottom portion of the pouch.

12. The tactical shoulder garment of claim 10, further comprising ballistic armor removably secured in the pouch.

13. The tactical shoulder garment of claim 10, wherein the inside of the pouch comprises a hook and loop surface configured to mate with a complimentary hook and loop surface of a ballistic armor.

14. The tactical shoulder garment of claim 1, wherein the distal end of the shoulder strap comprises a hook and loop surface configured to mate with a complimentary hook and loop surface of the tactical vest.

15. A tactical shoulder garment comprising:

a ballistic carrier configured to fit over a human shoulder and upper arm area, the carrier having a top portion with an opening, and a bottom portion with an opening; and a shoulder strap comprising an elastic band with a proximal end and a distal end, the proximal end being removably attachable to the top portion of the carrier through the opening of the top portion of the carrier, the distal end being removably attachable to a tactical vest;

wherein the opening of the bottom portion of the carrier is closeable to removably secure ballistic armor within the carrier.

16. The tactical shoulder garment of claim 15, wherein the proximal end of the shoulder strap comprises a strap-stop configured to allow the shoulder strap to be removably attachable to the top portion of the carrier near the opening of the top portion of the carrier.

17. The tactical shoulder garment of claim 16, wherein the opening at the top of the carrier is configured to allow the distal end of the shoulder strap to pass therethrough and to catch the strap-stop on an inside of the carrier.

18. The tactical shoulder garment of claim 17, wherein the distal end of the shoulder strap comprises a hook and loop surface configured to be removably attachable to a tactical vest having a complimentary hook and loop surface.

19. The tactical shoulder garment of claim 15, wherein the distal end of the shoulder strap comprises a hook and loop surface configured to be removably attachable to a tactical vest having a complimentary hook and loop surface.

20. The tactical shoulder garment of claim 15, further comprising an arm strap configured to removably secure the carrier to the upper arm area.

* * * * *